US005359800A

United States Patent [19]

Fisher et al.

[11] Patent Number: 5,359,800

[45] Date of Patent: Nov. 1, 1994

[54] ILLUMINATED GUN SIGHT

[75] Inventors: Bradley Fisher, Rehovot; Aharon Nechushtan, Kibbutz Hagoshrim, both of Israel

[73] Assignee: Scopus Light (1990) Ltd., Kibbutz Mayan Zvi, Israel

[21] Appl. No.: 895,924

[22] Filed: Jun. 9, 1992

[51] Int. Cl.[5] ..... F41G 1/32

[52] U.S. Cl. ..... 42/103; 33/241; 33/242

[58] Field of Search ..... 42/103, 100; 33/241, 33/242, 243, 261

[56] References Cited

U.S. PATENT DOCUMENTS

| | | | |
|---|---|---|---|
| 795,584 | 7/1905 | Daniel . | |
| 1,363,553 | 12/1920 | Barringer . | |
| 1,982,058 | 11/1934 | King . | |
| 2,527,043 | 10/1950 | Wallhausen | 33/241 |
| 2,987,821 | 6/1961 | Kettler | 33/241 |
| 3,316,109 | 4/1967 | Rimbach . | |
| 3,342,743 | 9/1967 | Rosenberg . | |
| 3,366,573 | 1/1968 | Feuer . | |
| 3,436,242 | 4/1969 | Schaffner | 117/8 |
| 3,456,043 | 7/1969 | Emery . | |
| 3,641,676 | 2/1972 | Knutsen | 33/52 |
| 3,698,092 | 10/1972 | Rosenhan | 33/241 |
| 3,701,900 | 10/1972 | Thuler | 240/2.1 |
| 3,706,543 | 12/1972 | Thuler | 65/105 |
| 3,834,035 | 9/1974 | Merrill | 33/241 |
| 3,908,055 | 9/1975 | Susuki | 428/67 |
| 3,914,873 | 10/1975 | Elliot | 33/241 |
| 4,020,203 | 4/1977 | Thuler | 428/35 |
| 4,695,159 | 9/1987 | Cannon | 33/241 |
| 5,065,519 | 11/1991 | Bindon | 33/242 |

FOREIGN PATENT DOCUMENTS

| | | | |
|---|---|---|---|
| 470016 | 2/1992 | European Pat. Off. | 33/241 |
| 1300959 | 7/1962 | France | 42/100 |
| 2572802 | 5/1986 | France | 33/241 |

OTHER PUBLICATIONS

National Defense, vol. LXVI, No. 374, p. 64, Night Firing Upgraded, Jan. 1982.

*Primary Examiner*—Stephen M. Johnson
*Attorney, Agent, or Firm*—Ladas & Parry

[57] ABSTRACT

An illuminated gun sight which includes a housing configured for mounting onto a gun and defining a recess having an opening to the exterior of the housing; one or more radioluminous light sources; and apparatus for mounting the one or more radioluminous light sources in the recess so as to expose to a viewer through the opening a predetermined portion of the one or more radioluminous light sources, wherein the recess also has an inward-facing surface having a light reflective coating generally surrounding the one or more radioluminous light sources, the light reflective coating being operative to reflect incident light outwardly through the opening so as to have the appearance in daylight, when viewed from at least a predetermined distance, of a light colored dot, and so as further to have the appearance of an illuminated dot in low light conditions, and wherein the location and size of the illuminated dot are identical to those of the light colored dot.

4 Claims, 4 Drawing Sheets

FIG.3
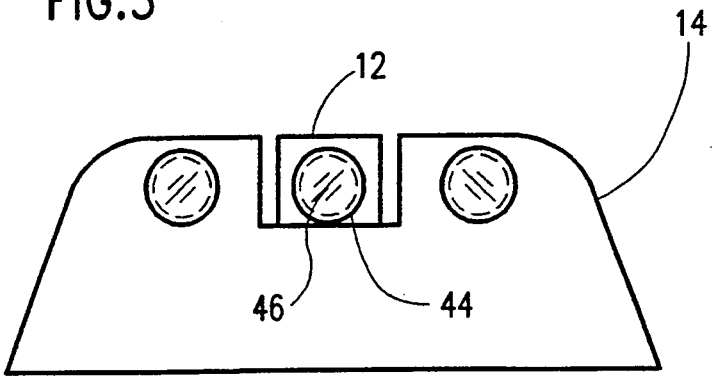
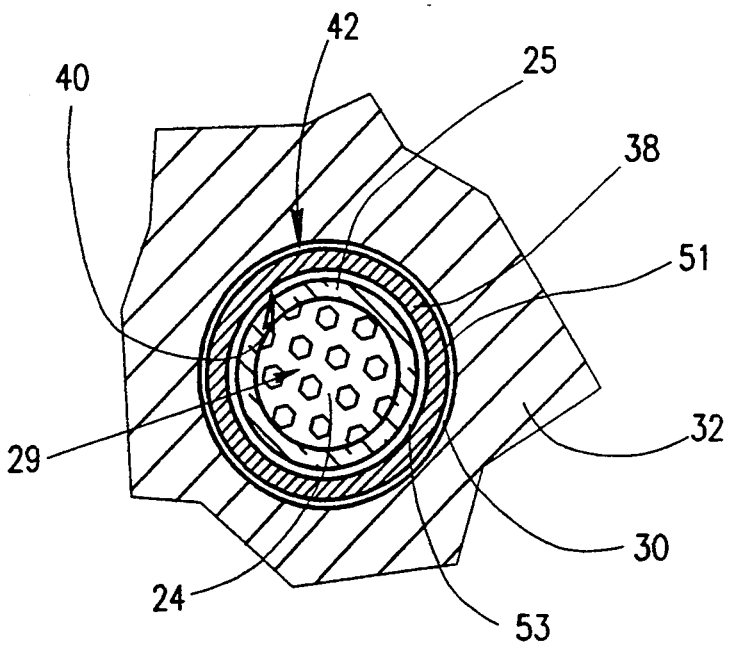
FIG.2B

ILLUMINATED GUN SIGHT

FIELD OF THE INVENTION

The present invention relates to gun sights in general, and to illuminated gun sights, in particular.

BACKGROUND OF THE INVENTION

Traditionally, under normal daylight conditions, a weapon having both front and rear sights is aimed by aligning the front sight such that its top just exposes the point on the target where impact is desired, and by subsequently "bracketing" the front sight in the sight notch of the rear sight, while ensuring that the tops of both the front and rear sights are aligned in the same horizontal plane.

It is known to paint white dots onto the gun sights. Typically, two white dots are provided symmetrically about the sight notch of the rear sight, and a single white dot is provided on the front sight. Although these white dots are useful primarily in daylight, they have also been found to be of some assistance in aiming the gun in low light conditions.

Radioluminous gaseous tritium light sources are also known to be incorporated into gun sights so as to enhance target acquisition under low light conditions. The tritium light sources are housed in a bore or slit formed in the gun sights and are arranged so as to appear as illuminated dots. Painting of white circles around the light sources on the rearward looking faces of the sights is also known, with the aim of providing an appearance in daylight similar to the appearance of the sights in low light conditions. A disadvantage of this arrangement, however, is that a user has to become used to two different appearances of the sights as, in daylight, only 'empty' white circles are visible, while, in low light conditions, only the light sources are seen.

Although tritium light sources are conventionally attached directly to the body of the sights, a radioluminous light source housed in a metal holder may be inserted via the holder into an appropriate bore formed in the body of a sight. The holder is fastened to the sight via a very thin layer of a flexible RTV silicone adhesive. A white circle may also be painted about the light source on the rearward face of the sight.

In this arrangement too, the sights have very specific and distinct daylight and low light appearances. In daylight, there appears a white circle having therein an 'empty' metallic circle (defined by an exposed edge of the holder), while, in low light conditions, substantially only the tritium light source is visible. Accordingly, a marksman must become proficient at using both the circles and the illuminated dots.

It would be advantageous to provide illuminated gun sights which have a generally similar appearance regardless of the ambient light level.

A further disadvantage in the conventional use of gaseous tritium light sources is the incompatibility of glass, which forms an outer casing of the light sources, and metal, from which the body of gun sights are made. None of the above-described prior art arrangements employing a radioluminous light source provides mounting thereof inside a metal housing in a manner that cushions a tritium light source therein against impact forces, vibration forces, and thermal expansion forces applied by the housing.

U.S. Pat. No. 5,065,519 describes a sight for a hand weapon which includes a sight blade, a bore located in the sight blade, and a self luminous capsule located in the bore for providing night sighting. The self luminous capsule has a generally circular light transmitting end which is located concentrically within said bore so as to define therewith an annular cavity surrounding said light transmitting. A substantially white material is provided within the annular cavity so as to define a white ring, thereby to provide improved day sighting.

U.S. Pat. No. 3,641,676, entitled "Radioluminous Gunsight and Method" discloses a gun sight coated with a radioluminous material so as to render the sight visible in low light conditions. The radioluminous material is applied in the form of a coating to selected surfaces of the gun sight. The radioluminous material is applied either directly to a gun sight, or is mounted thereon via a housing containing an amount of the radioluminous material.

U.S. Pat. Nos. 3,914,873 and 3,698,092 relate to electrically powered illuminated gun sights.

The following publications relate generally to gun sights: U.K. Patent No. 125,052 and U.S. Pat. Nos. 795,584 1,363,553 and 1,982,058.

The following publications describe chemical light sources: U.S. Pat. Nos. 3,316,109; 3,342,743; 3,366,573; 3,436,242; 3,456,043; 3,701,900; 3,706,543; 3,908,055 and 4,020,203.

SUMMARY OF THE INVENTION

The present invention seeks to provide an illuminated gun sight having an illuminated portion whose appearance remains generally unchanged, regardless of changes in the ambient light level.

The present invention further seeks to provide a set of illuminated gun sights having a plurality of illuminated portions whose overall appearance remains generally unchanged, regardless of changes in the ambient light level.

There is provided, therefore, in accordance with an embodiment of the invention, an illuminated gun sight which has a housing configured for mounting onto a gun and defining a recess having an opening to the exterior of the housing; one or more radioluminous light sources; and apparatus for mounting the one or more radioluminous light sources in the recess so as to expose to a viewer through the opening a predetermined portion of the one or more radioluminous light sources, wherein the recess also has an inward-facing surface having a light reflective coating generally surrounding the one or more radioluminous light sources, the light reflective coating being operative to reflect incident light outwardly through the opening so as to have the appearance in daylight, when viewed from a predetermined minimum distance, of a light colored dot, and so as further to have the appearance of an illuminated dot in low light conditions, and wherein the location and size of the illuminated dot are identical to those of the light colored dot.

Additionally in accordance with the invention, the light reflective coating is generally white, thereby imparting a generally white appearance to the light colored dot.

Further in accordance with the invention, the gun sight also includes light transmission apparatus arranged in the recess for transmitting light outwardly from the recess, thereby to provide in association with the opening the generally white dot in daylight and the illuminated dot in low light conditions.

Additionally in accordance with the invention, the light transmission apparatus defines an outward facing surface in association with the opening so as to define an optical plane thereat, and wherein the light transmission apparatus provides the generally white dot and the illuminated dot at the optical plane.

Further in accordance with the invention, the apparatus for mounting includes a resilient mounting member arranged between the housing and the radioluminous light source for absorbing mechanical forces damaging to the one or more radioluminous light sources that would otherwise be applied thereto by the housing, wherein the resilient mounting member is arranged within the recess and has an inward-facing, generally white, light reflective surface which surrounds the one or more radioluminous light sources, thereby also to reflect light outwardly through the opening of the recess.

Additionally in accordance with the invention, the radioluminous light source and the resilient mounting member together occupy a volume of a first magnitude in the recess, and the recess has a volume of a second magnitude, greater than the first magnitude, such that gaps remain in the recess that are occupied neither by the radioluminous light source nor by the resilient mounting member, and wherein the light transmission apparatus includes a light transmission medium occupying the gaps in the opening occupied neither by the radioluminous light source nor by the resilient mounting member.

BRIEF DESCRIPTION OF THE DRAWINGS

The present invention will be more fully understood and appreciated from the following detailed description, taken in conjunction with the drawings, in which:

FIG. 2B is a further, enlarged cross-sectional view of the front sight of FIG. 2A, taken along line 2B—2B therein;

FIG. 3 is an enlarged schematic view of front and rear sights as seen when aiming the handgun of FIGS. 1A and 1B, taken in the direction indicated by arrow III in FIG. 1A.

DETAILED DESCRIPTION OF THE INVENTION

Figure 1A:
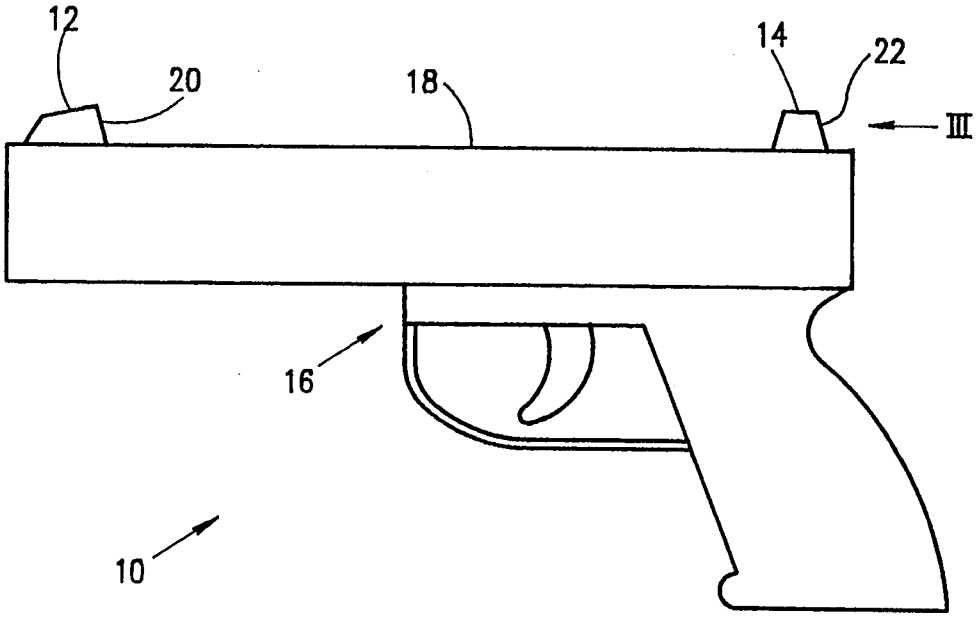
FIGS. 1A and 1B are respective side and rear views of a handgun on which are mounted illuminated front and rear sights, constructed in accordance with the present invention.
Figure 1B:
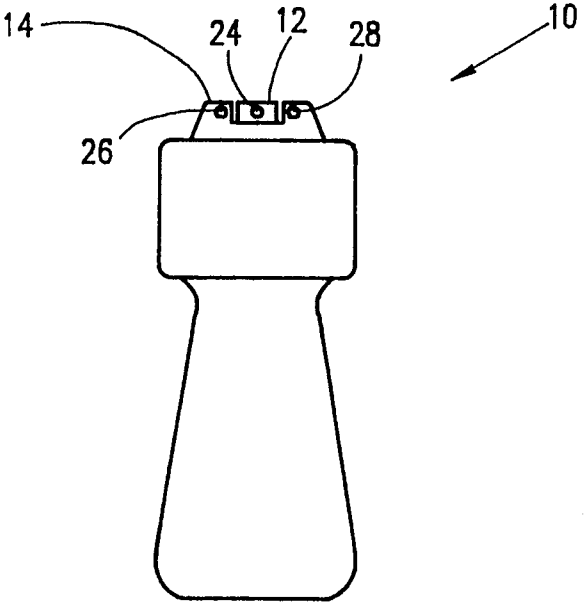

Referring now to FIGS. 1A and 1B, there is illustrated a handgun, referenced generally 10, having an illuminated front sight 12 and an illuminated rear sight 14, constructed in accordance with the present invention. Although the gun 10 is exemplified in the drawings as being a handgun, sights 12 and 14 may be employed with any suitable type of gun such as an assault rifle and the like. In the present example, the gun 10 has a main body, referenced generally 16, including a slide 18, to which sights 12 and 14 are attached.

Gun sights 12 and 14 have respective rearward facing surfaces, respectively referenced 20 and 22, into which are embedded a plurality of radioluminous light elements, referenced 24, 26 and 28 (FIG. 1B). The radioluminous light elements are typically gaseous tritium light sources of generally any selected color, as known in the art, and may be green, red, yellow, blue or white, for example.

As will be appreciated from the following description, a particular advantage of the present invention is that, unlike prior art gun sight arrangements employing white dots or radioluminous light elements (with or without the addition of painted white circles), a user does not have to become proficient in the use of separate day and night systems. Rather, with the sights of the present invention, no substantial adjustment on the part of the user is required in response to a change in the ambient light level. Accordingly, aiming becomes instinctive with benefits such as optimization in aiming accuracy and speed of reaction of a user.

Figure 2A:
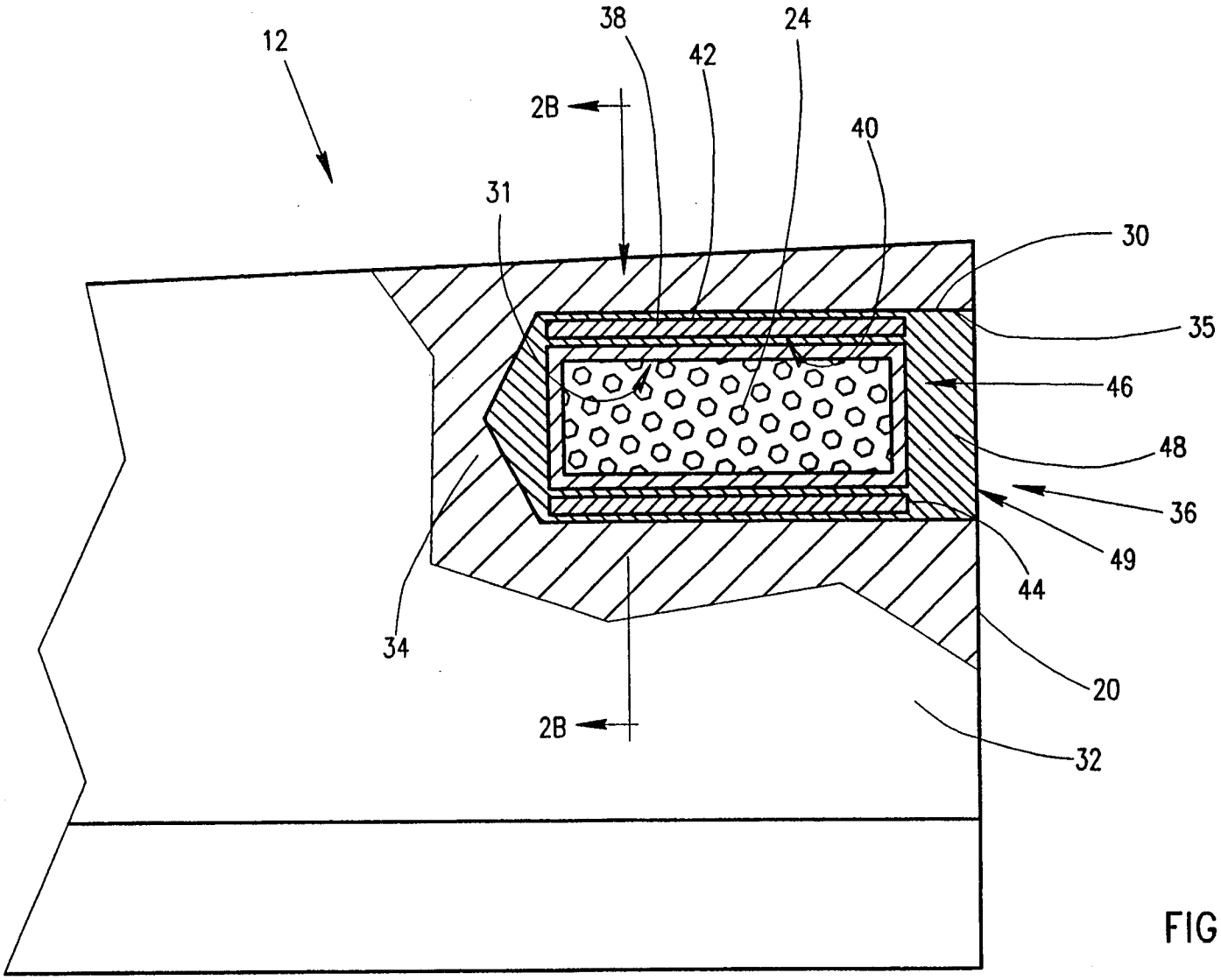
FIG. 2A is an enlarged cross-sectional view of the front sight of FIGS. 1A and 1B.

Referring now to FIGS. 2A and 2B, there is illustrated, in enlarged cross-sectional form, the illuminated front sight 12, constructed in accordance with a preferred embodiment of the invention. Although the present example is that of the front sight 12, the respective mounting arrangements of rear light elements 26 and 28 (FIG. 1B) are similar to that illustrated and described herein for light element 24 mounted in front sight 12, and thus are not specifically described herein.

Radioluminous light element 24 is preferably a gaseous tritium light source having a generally elongate, cylindrical glass casing 25 containing a small amount of tritium gas, indicated generally by reference numeral 29. An inward-facing surface 31 of glass casing 25 is coated with a thin layer of a phosphorescent material (not shown). The tritium gas emits charged particles which, when they impinge on the phosphorescent material, provide an uninterrupted source of light for an extended period of time.

According to the present invention, front sight 12 has a body portion 32, preferably made of metal, having a recess 30. Recess 30 is preferably in the form of a generally cylindrical bore. Recess 30 is configured to contain light element 24, and thus defines an opening 36 communicating with the rearward facing surface 20 of the body portion 32. Recess 30 also has a generally conical closed end 34.

Located within the recess 30 is a preferably white sleeve or liner 38 made of a generally resilient material. Although any suitable resilient material, such as a PVC, may be used, a material found by the inventors to be suitable for the present application is INSUL-105 PVC, catalog no. 4900, manufactured by INSUL-TAB INC., (a subsidiary of TELEFLEX), P.O.B. 526, 50 Everberg Road, Woburn, Mass. 01801, USA.

Sleeve 38 has an inward-facing surface 40 configured to retentively engage the exterior of light element 24 and an outward-facing surface 42 which is configured to retentively engage an inward-facing surface 35 of recess 30. Sleeve 38 defines a generally white edge portion 44 which surrounds a predetermined end portion 46 of the light element 24 so as to be visible, together therewith, through the opening 36 of recess 30.

Preferably the closed end 34 and the inward-facing generally cylindrical surface 35 of recess 30 are painted white, and the inward-facing surface 40 of the sleeve is also white. Although any suitable white paint may be used for painting closed end 34 and the exposed portion of inward-facing surface 35, a white paint found by the inventors to be suitable for this purpose is TILE CLAD EPOXY PAINT (B62 Series, color white), manufactured by THE SHERWIN WILLIAMS COMPANY, Stores Division, Industrial Maintenance Coatings, 1373 Euclid Avenue, Cleveland, Ohio 44115, USA.

It is a particular feature of the invention that the white surface finishes of surface 40 of the sleeve 38, of closed end 34, and of the exposed portion of inward-facing 35 of recess 30, together with the generally conical configuration of the closed end 34, combine to reflect light emanating from light element 24 outwardly through opening 36 of recess 30.

Accordingly, the present arrangement maximizes the use of the light provided by the light element 24 so as to provide a generally circular, illuminated dot that, in low light conditions, is as bright as possible. Furthermore, in daylight, a white dot is visible in the same position as the illuminated dot. The provision of white edge portion 44 of sleeve 38 and the above-described white, inward-facing surfaces associated with the recess 30 serve to enhance the visibility of the white dot in daylight.

Light element 24 and sleeve 38 are preferably set back inside recess 30 as illustrated, and a suitable light transmissive covering 48 is provided to extend across the recess 30 so as to cover end portion 46 of the light element 24 and edge portion 44 of sleeve 38. Covering 48 is typically an adhesive which, when cured, provides an optical plane at an exposed surface 49 thereof (FIG. 2A). Surface 49 has the appearance of a white dot in daylight and of an illuminated dot in low light conditions.

The white dot and illuminated dot are thus provided at the same location and they are also of identical size. Accordingly, a user does not need to adjust his aiming technique in response to a change in ambient light conditions.

Due to necessary manufacturing tolerances there exists a gap, referenced 51 (FIG. 2B) at the common interface of housing 32 and sleeve 38. When sleeve 38 and light element 24 are mounted in recess 30, the adhesive of which covering 48 is comprised is poured, in uncured liquid form, into the recess 30, so as to fill spaces not occupied by the light element 24 or the sleeve 38. Accordingly, the adhesive fills a generally conical space defined at closed end 34 of recess 30, gap 51 at the common interface of housing 32 and sleeve 38, and a gap 53 (if present) at the common interface of light element 24 and sleeve 38, as well as opening 36 of the recess.

As well as constituting a means of fixedly mounting light element 24 and sleeve 38 inside recess 30, the adhesive, once cured, also constitutes a light transmission medium, which further improves the optical characteristics of the gun sight, maximizing the whiteness of the white dot provided in daylight and maximizing the intensity of the illuminated dot visible in low light conditions.

Although any suitable adhesive may be used, an adhesive found by the inventors to be suitable for use as covering 48 is METRE-GRIP 303 EPOXY, manufactured by MERECO PRODUCTS DIVISION, Metachem Resins Corp., of 1500-T Main St., West Warwick, R.I. 02893, USA.

Referring now briefly to FIG. 3, it will be appreciated that during daylight the overall appearance of light elements 24, 26 and 28 with their respective sleeves and coverings, as viewed by a user, is that of three white dots. Under low light conditions, in place of the three white dots, the user will see three illuminated dots whose respective sizes and shapes are identical to those of the white dots.

As described in the Background of the Invention, a disadvantage of the conventional use of gaseous tritium light sources in gun sights is the incompatibility of the glass, which forms an outer casing of the light sources and which is inherently brittle, and the metal body of the gun sights. In particular, there exists a problem of mechanical incompatibility, in that any shock forces or vibrations experienced by the gun and, therefore, by the gun sights, are transmitted to the light sources, possibly resulting in cracking thereof. A further problem, that of thermal expansion of the metal body in which the light source is mounted, could lead to crushing of the glass casing thereof.

As stated hereinabove, however, sleeve 38 is made of a resilient material and thus serves to mechanically cushion the light element 24 so as to absorb shock forces and vibrations applied thereto by the housing 32. Furthermore, the inherent compressibility of the sleeve permits thermal expansion of the metal housing 32, while preventing application of thermal expansion forces to light element 24, thereby preventing the glass casing 25 thereof from being crushed.

Figure 4C:
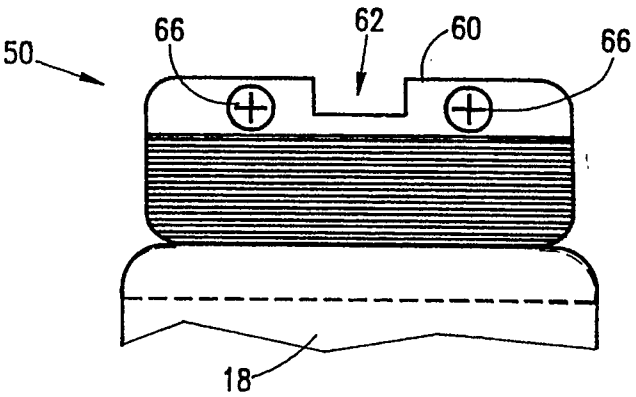
FIGS. 4A, 4B and 4C are respective side, top and front views of an adjustable, illuminated rear gun sight, constructed in accordance with a further embodiment of the invention.
Figure 4A:
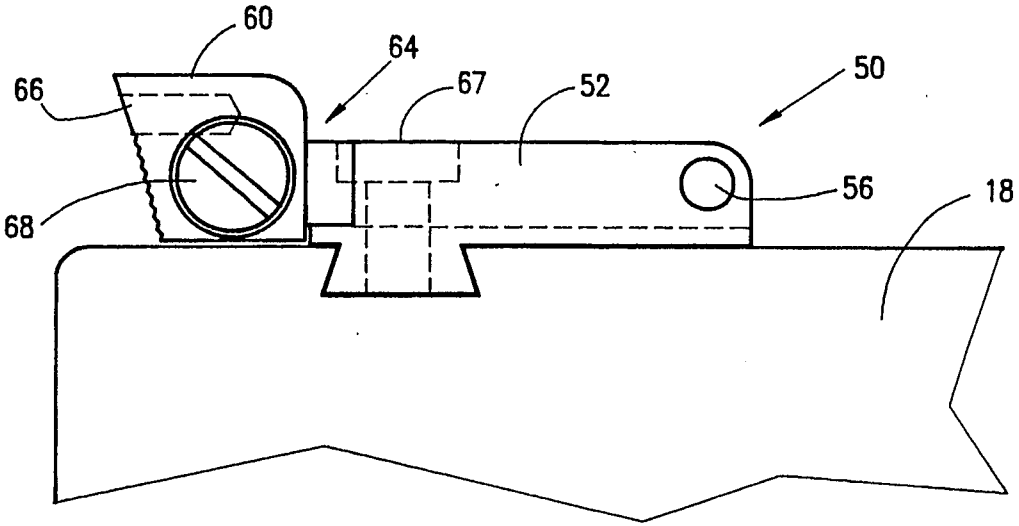
Figure 4B:
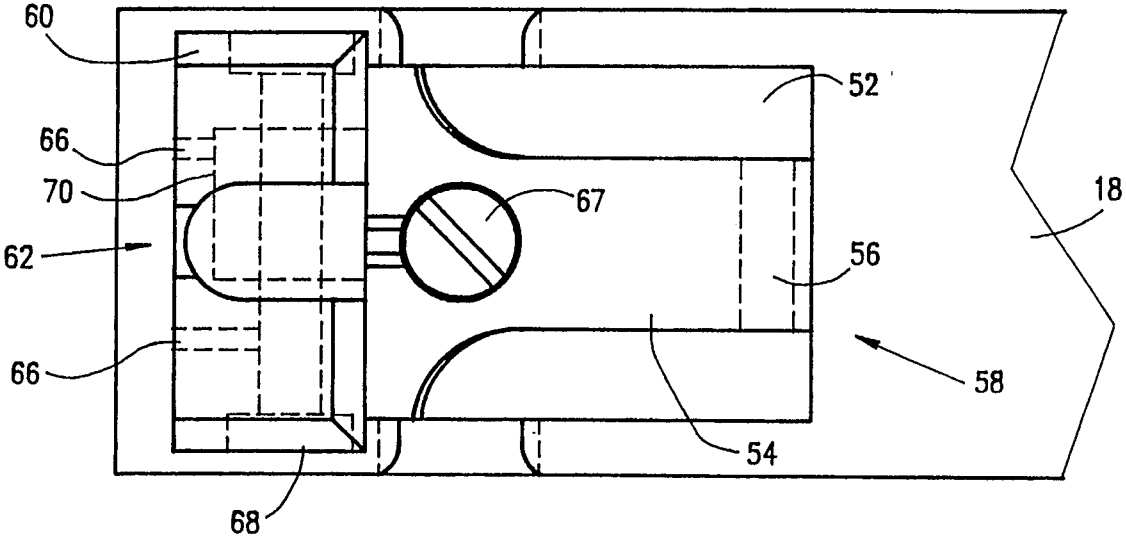

Referring now to FIGS. 4A–4C, there is illustrated an adjustable, illuminated rear sight, referenced generally 50, mounted onto slide 18 of gun 10, constructed in accordance with an alternative embodiment of the present invention.

As illustrated, sight 50 includes a base 52, fixedly attached, as by dovetailing, to slide 18. A lever arm 54 is attached via a hinge 56 to a front portion 58 of base 52, while a blade 60, defining a sight notch 62, is attached to a rear portion 64 of lever arm 54. A pair of radioluminous light elements 66, similar to light elements 24, 26 and 28 (FIG. 2), are mounted in blade 60 in substantially identical fashion to the manner in which light elements 24, 26 and 28 are mounted in front and rear sights 12 and 14.

Sight 50 may be adjusted for elevation and windage. Elevation adjustment is provided by means of an elevation screw 67 extending transversely through lever arm 54 and base 52. Rotation of elevation screw 67 in one direction causes displacement of lever arm 54 relative to base 52, while rotation in the opposite direction causes lever arm 54 to close on base 52.

Windage adjustment is provided by a windage screw 68 extending longitudinally through blade 60. Screw 68 cooperates with an internally threaded mounting element 70 which is formed in a rear portion of lever 54, such that rotation of screw 68 in one direction causes a transverse displacement of blade 60 relative to the remainder of sight 50 in a first direction, while an opposite rotation of screw 68 causes an opposite displacement of sight 50, in a second direction.

An advantage of the present embodiment is that front sight 12 (FIGS. 1A–3) and rear sight 50 (FIGS. 4A–4C) combine to provide a sight system of which the rear sight is adjustable and whose appearance remains generally constant, regardless of the ambient light conditions. Accordingly, the present sight system is of increased versatility when compared with conventional sight systems.

It will be appreciated by persons skilled in the art that, the scope of the present invention is not limited by what has been particularly shown and described hereinabove by way of example. The scope of the invention is limited, rather, solely by the claims, which follow.

We claim:

1. An illuminated gun sight for day and night use comprising:

a housing defining a recess;

a radioluminous light source mounted in said recess;

light reflecting and transmitting material disposed in said recess outside of said light source and being operative to provide the appearance of a full white dot under full light conditions and the appearance of a full dot under other light conditions, wherein said light reflecting and transmitting material comprises:

a light reflecting coating disposed on the interior of the recess; and a white insert disposed in the recess and surrounding the light source.

2. An illuminated gun sight according to claim 1 and wherein said light reflecting and transmitting material also comprises substantially fully light transmissive adhesive disposed about said light source in said recess.

3. An illuminated gun sight according to claim 1 and wherein said light reflecting and transmitting material also includes substantially fully light transmissive adhesive disposed between the light source and said white insert and between said white insert and said light reflecting coating.

4. An illuminated gun sight according to claim 3 and wherein said recess includes a closed end surface and a cylindrical surface and wherein said light reflecting coating is disposed both on said closed end surface and on said cylindrical surface.

* * * * *